US005818352A

United States Patent [19]

McClure

[11] Patent Number: 5,818,352

[45] Date of Patent: Oct. 6, 1998

[54] WELL DATA TELEMETRY SYSTEM

[75] Inventor: Paul Anthony McClure, Aberdeen, Scotland

[73] Assignee: Integrated Drilling Services Limited, Aberdeen, Scotland

[21] Appl. No.: 976,084

[22] Filed: Nov. 21, 1997

Related U.S. Application Data

[63] Continuation of Ser. No. 523,255, Sep. 5, 1995.

[30] Foreign Application Priority Data

Sep. 3, 1994 [GB] United Kingdom ..... 9417719

[51] Int. Cl.[6] ..... G01V 3/00

[52] U.S. Cl. ..... 340/854.6; 340/854.5; 175/40

[58] Field of Search ..... 340/854.6, 854.8, 340/854.3, 854.4, 854.5; 175/40, 50

[56] References Cited

U.S. PATENT DOCUMENTS

| | | | |
|---|---|---|---|
| 3,967,201 | 6/1976 | Rorden | 340/854.6 |
| 4,072,200 | 2/1978 | Morris et al. | 175/45 |
| 4,301,408 | 11/1981 | Paddison et al. | 324/141 |
| 4,363,137 | 12/1982 | Salisbury | 455/40 |
| 4,800,385 | 1/1989 | Yamazaki | 340/854.6 |
| 4,992,787 | 2/1991 | Helm | 340/854 |

FOREIGN PATENT DOCUMENTS

WO 87/04028 7/1987 WIPO .

*Primary Examiner*—J. Woodrow Eldred
*Attorney, Agent, or Firm*—Young & Thompson

[57] ABSTRACT

A well data telemetry system for transmitting data along at least a part of a well bore containing tubing of magnetically permeable material comprises a transmitting coil located to transmit a magnetic flux signal along the tubing and/or the surrounding geological formations, modulation circuitry connected to the coil for modulating the magnetic flux signal in response to a data signal, and an a.c. magnetometer located to detect and respond to the magnetic flux signal at a position spaced from the transmitting coil. By using an a.c. magnetometer instead of a conventional receiver coil to detect and respond to the magnetic flux signal, the system is capable of responding to the low levels of signal which are likely to be received in practice. Furthermore, the response of the a.c. magnetometer is independent of frequency so that the system may be used at low frequencies as well as high frequencies and demodulation of the transmitted signal can be effected without difficulty.

19 Claims, 3 Drawing Sheets

WELL DATA TELEMETRY SYSTEM

This application is a continuation of application Ser. No. 08/523,255, filed Sep. 5, 1995, now abandoned.

BACKGROUND TO THE INVENTION

The invention relates to a well data telemetry system for transmitting data long a well bore. Primarily, data requires to be transmitted upwardly along a well bore so as to transmit to the surface data acquired, during the drilling of the well bore, by instruments mounted downhole. However, data may also require to be transmitted from the bottom of a production well bore, and in some cases it may be required to transmit control data from the surface down the well bore to a controllable device, such as a steering system, located downhole. "Short hop" telemetry may also be required from one part of a well bore to another.

Various systems have been employed for transmitting data along a well bore, one of the commonest being mud pulse telemetry where data pulses are transmitted through the drilling mud which is pumped down the bore hole being drilled. However, the present invention relates to a particular form of telemetry system where data is transmitted by means of a magnetic flux signal induced through magnetically permeable tubing extending along the bore hole. A system of this kind is described in U.S. Pat. No. 4,800,385. In the arrangement described in this patent a carrier signal is modulated by a downhole data signal and is then applied to a transmitting coil wound on the bottom portion of the drilling string to induce a magnetic flux signal in the drill string material. The magnetic flux signal is picked up as an electrical signal at a receiver coil disposed around an exposed end of the drill string at the surface. The electrical signal is equivalent to the modulated data signal. The receiver coil provides a voltage output which is proportional to the rate of change of magnetic flux through the coil area.

However, such an arrangement suffers from severe practical disadvantages. The transfer function of a magnetically permeable material produces a signal that attenuates approximately as the inverse square of the distance from the transmitter to the receiver. In a communication system used in a well bore that may be up to 7000 meters in depth, the use of a receiver coil to measure the transmitted magnetic flux energy which is likely to be achieved in practice is difficult due to the physical number of turns required in the coil, and the high noise which occurs due to the resistance of the element. Also, the extremely low voltage levels produced are beyond the capabilities of voltage measuring equipment to measure accurately. In addition, the response of the receiver coil is frequency dependent making demodulation of transmitted signals problematical, and a practical system is not feasible at low frequencies.

The present invention provides an improved well data telemetry system where these difficulties may be overcome.

SUMMARY OF THE INVENTION

According to the invention there is provided a well data telemetry system for transmitting data along at least a part of a well bore containing tubing of magnetically permeable material, the system comprising a transmitting coil located to transmit a magnetic flux signal along the tubing and/or the surrounding geological formations, means connected to the coil for modulating the magnetic flux signal in response to a data signal, and an a.c. magnetometer located to detect and respond to the magnetic flux signal at a position spaced from the transmitting coil. An a.c. magnetometer is a transducer instrument that has a known transfer function between the amplitude and phase of an alternating magnetic flux at its input to a voltage, current or frequency at its output.

By using an a.c. magnetometer instead of a conventional receiver coil to detect and respond to the magnetic flux signal, the system is capable of responding to the low levels of signal which are likely to be received in practice. Furthermore, the response of the a.c. magnetometer is independent of frequency so that the system may be used at low frequencies as well as high frequencies and demodulation of the transmitted signal can be effected without difficulty.

Preferably the magnetometer is capable of detecting magnetic flux levels of $10^{-12}$ Tesla or less from 0.5 Hz up to at least 10 Khz, and more preferably up to 500 Khz. The magnetometer may, for example, be an yttrium iron garnet magnetometer.

The transmitting coil may be located downhole and the magnetometer located at the surface, whereby the system may transmit to the surface data relating to conditions downhole. In this case the downhole unit may comprise sensors for measuring parameters close to the bottom of the well bore, a source of electrical power such as a battery or turbine generator, an oscillator to generate an oscillating carrier signal of a predetermined frequency and a modulator to modulate the carrier signal by the data signal from the sensors, the modulated carrier signal being applied to the transmitting coil to produce a modulated magnetic flux signal.

The receiving assembly may comprise a power source, such as a battery or turbine generator, and the a.c. magnetometer mounted on the tubing at the surface. The magnetometer senses the magnetic flux transmitted up the tubing which is equivalent to the modulated carrier wave. The received signal is then processed, displayed and/or recorded on the surface.

Alternatively, the transmitting coil may be located at the surface and the magnetometer located downhole, whereby the system may transmit control data to a controllable downhole device. In a further embodiment of the invention, both the transmitting coil and the magnetometer may be located downhole, whereby the system may transmit data from one downhole location to another. In such a system, known as a "short hop" system, the downhole unit may be similar to that referred to above for transmission of signals to the surface but in this case the output of the downhole magnetometer may be transmitted to a mud pulse telemetry measurement while drilling (MWD) system for onward transmission to the surface.

Said tubing of magnetically permeable may comprise a drill string comprising connected lengths of drilling tube. Alternatively, the tubing may comprise the continuous tubing of a coiled tubing unit. Such coiled tubing unit may comprise a continuous coiled drill string for drilling the well bore, or may comprise a unit separate from the drill string for running downhole sensors in the well bore. Alternatively, the tubing might comprise the production tubing in a producing well bore.

DETAILED DESCRIPTION OF THE PREFERRED EMBODIMENTS

Figure 1:
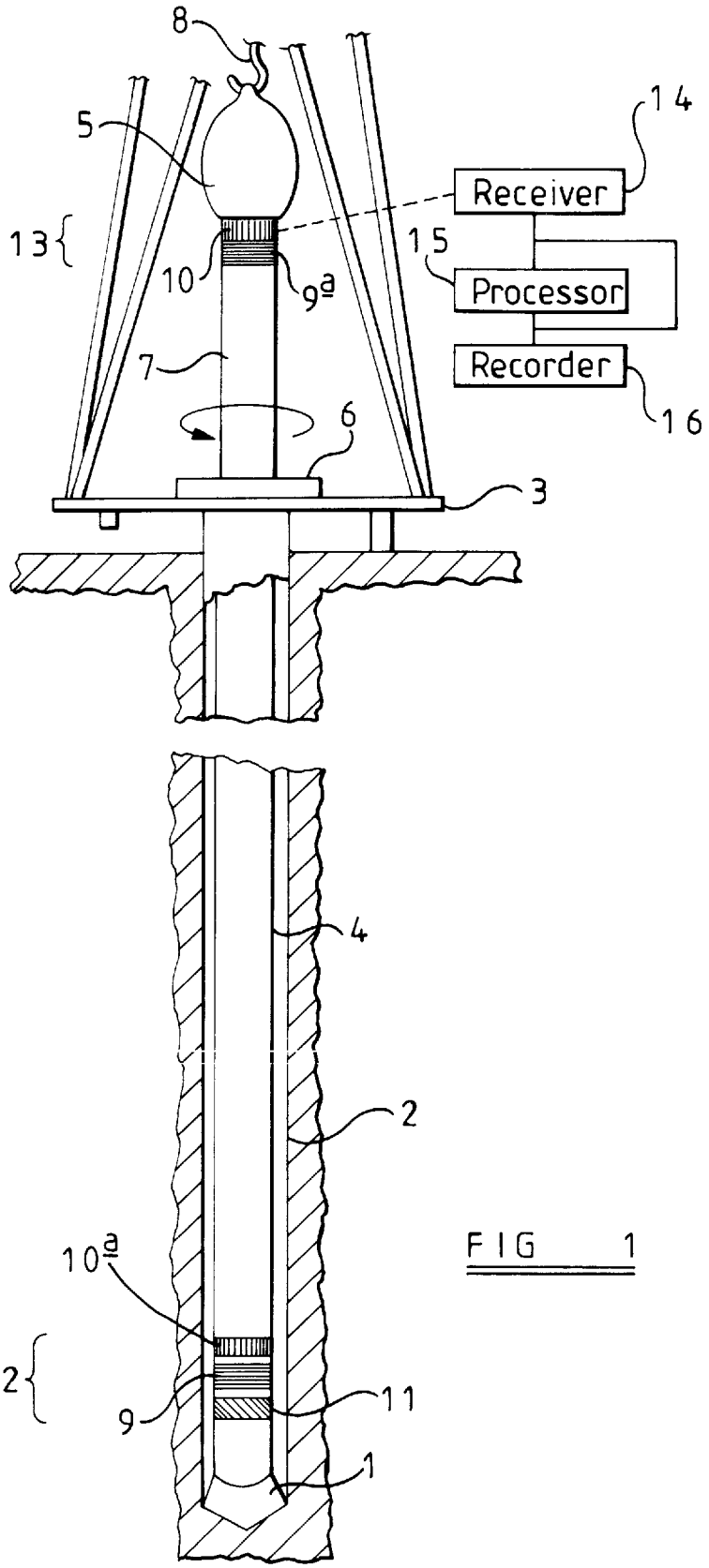
FIG. 1 is a diagrammatic section through a well bore and drilling rig, showing one embodiment of the invention.

Referring to FIG. 1, a platform and derrick 3 is positioned over a well bore 2. The drill string 4 is suspended in the well bore with a drill bit 1 attached to its lower end. The upper end of the drill string 4 is attached to a kelly 7 which is rotated by a rotary table 6. The drill string 4 is suspended from a hook 8 which is attached to a travelling block (not shown). The kelly 7 is attached to the hook 8 by means of a rotary swivel 5 which allows the kelly and drill string to rotate relative to the hook 8.

Mounted in the drill string, preferably close to the drill bit 1, are sensors indicated diagrammatically at 11 to measure well bore and drilling parameters. The sensors are mounted in the downhole unit 12 and may comprise a plurality of sensors, such as inclinometers and magnetometers to measure bore hole inclination and azimuth, formation evaluation sensors such as scintillation sensors to measure natural formation radiation, electromagnetic wave propagation resistivity sensors to measure formation resistivity, and drilling sensors such as strain gauges to measure weight on bit, rotary torque and bending moment.

The sensor outputs are input to a suitable processing system (not shown) mounted in the downhole unit 12. The downhole unit 12 also contains a transmitting coil 9 wound on a magnetic or non-magnetic section of the drill string or on a former surrounded by the magnetically permeable material that comprises the drill string. The downhole unit also contains a suitable source of electrical power, such as a battery or a turbine generator driven by drilling fluid. The power source is used to provide power to the sensors, processing system and transmitting coil 9.

The downhole unit 12 also contains an oscillating circuit to create an oscillating carrier signal. This oscillating carrier signal is modulated by a modulating circuit such that the modulated oscillating carrier signal is equivalent to the sensor signals. The modulated oscillating carrier signal is then fed to the transmitting coil 9.

The modulating oscillating carrier signal being fed into the transmitting coil 9 causes the coil to create a modulated oscillating magnetic field which is then transmitted up the drill string. Since the magnetic permeability of the drill string is comparatively much higher than the magnetic permeability of the formation surrounding the well bore, little magnetic flux energy will leak into the formation, and the majority of the magnetic flux will be transmitted up through the drill string.

The surface receiving unit 13 comprises a power source such as a battery or drilling fluid driven turbine, the output of which is used to power the circuits controlling a magnetometer indicated diagrammatically at 10. The magnetometer 10 measures the modulated oscillating magnetic flux induced in the drill string by the downhole unit 12. The magnetometer 10 is a high sensitivity a.c. magnetometer of a kind capable of measuring magnetic flux levels of 10E-15 or greater. This level of sensitivity in the magnetometer is required to facilitate the accurate detection of low levels of magnetic flux energy which result from the magnetic flux energy having been transmitted through large lengths of drill string. Well bores that are drilled to a shallow depth can be handled with magnetometers of low sensitivity. The magnetometer output is connected to a surface receiver circuit 14 and a processor 15 which processes the received data and displays the data. Received data can also be recorded in a surface recorder 16.

The magnetometer 10 is a 3-component gradiometer comprising two identical magnetic field sensors positioned close to one another and so spaced and disposed as to substantially eliminate surface noise generated by electrical, local magnetic or geomagnetic sources. Each magnetic field sensor consists of a monocrystal film of Yttrium Iron Garnet (YIG) grown by liquid phase epitaxy on a Gallium Gadolinium Garnet (GGG) substrate and wound with five coils, two of which are used to produce a rotating magnetic field in the film and three of which are measured coils. The YIG film, which is a ferromagnetic film of high susceptibility and low saturation field, is grown with [111] orientation. In operation the measurement coils of each magnetic sensor supply signals indicative of the magnetic field in the YIG film independently to a respective processing channel associated with each sensor channel, and the information from the two channels is then processed in such a way as to provide a measurement of the gradient of each component of the magnetic field. The measurement technique used may be a null method in which feedback to the coils is provided to produce a compensating field to cancel the ambient magnetic field. Such a gradiometer is supplied by IMC Limited of Salford, England and is described in the paper "Three Component Magnetic Measurement using the Cubic Anisotropy in [111] YIG Films" by A. Y. Perlov, A. I. Voronko, P. M. Vetoschko and V. B. Volkovoy. Such a gradiometer provides simultaneous measurement of the gradient of each component of the magnetic field and is highly sensitive since noise is reduced to a very low level.

The receiver topology consists of two or more sensors positioned either on or within the drill string or alternatively on the ground or sea bed. The signals received are indicative of flux generated at the transmitter source less the attenuation. Other signals received are noise components and are typically common mode to the sensors or not from the downhole signal source. Thus the signals received by the magnetic sensors are in the form:

$$Fr_1 = Fcom + F\text{signal}_1$$

$$FR_2 = Fcom + F\text{signal}_2$$

where Fcom represents the common mode components and $F\text{signal}_1$ and $F\text{signal}_2$ represent the components from the downhole signal source.

Subtracting the two signals results in considerable reduction of common mode noise interference due to electrical, local magnetic or geomagnetic sources.

The use of three orthogonal sensors in such an array allows the magnetic and direction of common mode and signal sources to be determined.

In the embodiment of FIG. 1 the drill string is of the kind comprising a series of separate drilling pipes connected together end-to-end. It will be appreciated, however, that the tubing along which the magnetic flux signal is transmitted may be of any other suitable type, provided that it is magnetically permeable. For example, the drilling rig may be of the kind using a coiled tubing unit where the drill string is part of a single continuous coil of tubing. In a further embodiment, instead of transmitting the magnetic flux signal through a drill string, the signal may be transmitted through production tubing in a producing well, in which case the data sensed at the lower portion of the well bore will normally be production data.

In another embodiment, the tubing may be separate from the drill string and may, for example, comprise a coiled tubing unit for running downhole sensors into the well bore.

In some cases the system may be used to transmit data downhole, for example to control a downhole device, such as a steering system. In this case the transmitter coil is provided on the drill string at the surface, as indicated diagrammatically at 9*a*, and the magnetometer is provided downhole, as indicated at 10*a*.

Figure 2:
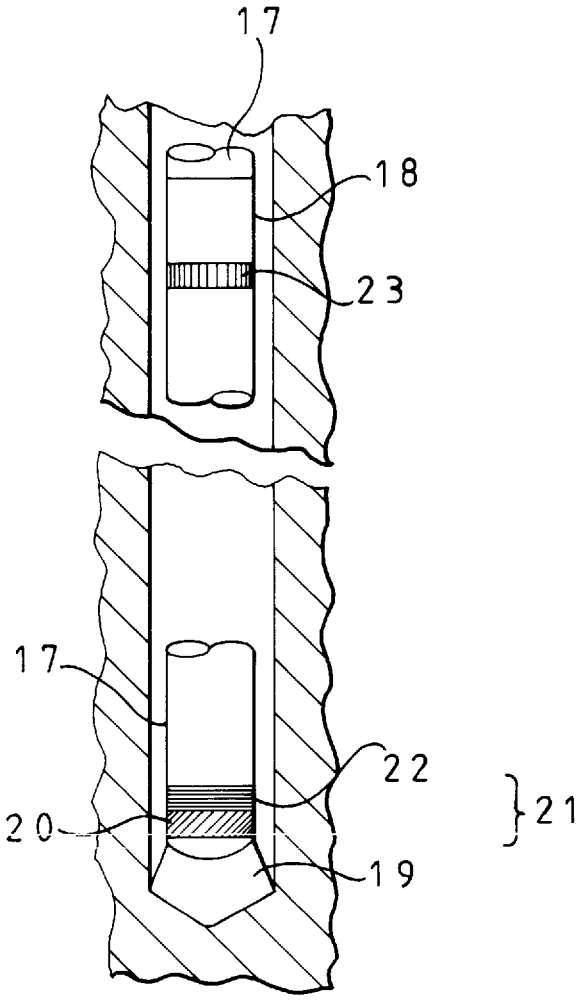
FIGS. 2 and 3 are diagrammatic sections through the lower part of a well bore and drill string showing alternative embodiments of the invention.

FIG. 2 illustrates diagrammatically an alternative embodiment of the invention and relates to a so-called "short hop" telemetry system.

In this embodiment the lower portion of the drill string 17 incorporates a mud pulse telemetry MWD system, indicated diagrammatically at 18. The mud pulse telemetry MWD system is mounted in the drill string some distance above the drill bit 19 and is not itself directly electrically connected to a sensor package 20 contained in the downhole unit 21, which is mounted close to the drill bit 19.

The sensor package 20 comprises a plurality of sensors, such as inclinometers and magnetometers to measure bore hole inclination and azimuth, formation evaluation sensors such as scintillation detectors to measure natural formation radiation, electromagnetic wave propagation resistivity sensors to measure formation resistivity, and drilling sensors such as strain gauges to measure weight on bit, rotary torque and bending moment. The sensor outputs are input to a suitable processing system mounted in the downhole unit 21.

The downhole unit 21 also contains a transmitting coil, indicated diagrammatically at 22, wound on to the magnetically permeable material that comprises the drill string. The downhole unit 21 also contains a suitable source of electrical power (not shown) such as a battery or drilling fluid driven turbine generator, which is used to provide power to the sensors, processing system and to the transmitting coil 22. The downhole unit 21 also contains an oscillating circuit to create an oscillating carrier signal, which is modulated by a modulating circuit such that the modulated oscillating carrier signal is equivalent to the sensor signals. The modulated oscillating carrier signal is fed to the transmitting coil 22.

The coil 22 creates a modulated oscillating magnetic field which is transmitted up the portion of the drill string between the coil 22 and a receiving unit 23. Again, since the magnetic permeability of the drill string is comparatively much higher than the magnetic permeability of the formation surrounding the well bore, little magnetic flux energy will leak into the formation, and the majority of magnetic flux will be transmitted up through the drill string.

In this case the receiving unit 23 is located adjacent the mud pulse telemetry MWD system 18 and comprises a power source (not shown) such as a battery or drilling fluid driven turbine the output of which is used to power the circuits controlling the a.c. magnetometer contained in the receiving unit 23. The magnetometer measures the modulated oscillating magnetic flux transmitted by the downhole unit 21, and the magnetometer output is fed to a processor which then transfers the received sensor data to the mud pulse telemetry MWD system 18, which in turn transmits the data to the surface of the well bore, by means of pulses in the flow of drilling mud, in well known manner.

This embodiment facilitates the measurement of drilling and formation parameters close to the drill and the transfer over a short distance (typically less than 300 feet) of the sensor data to a conventional mud pulse telemetry MWD system. This arrangement then requires only the portion of the drill string between the downhole unit 21 and receiving unit 23 to be formed of magnetically permeable material.

As previously disclosed, the signal source constituted by the downhole transmitting coil can be positioned on a magnetic or non-magnetic section of the drill string (that is on a drill pipe or non-magnetic drill collar) or on a former of magnetic or non-magnetic material disposed within the drill string. The dipole source can be positioned within the material with the transmitter oriented such that the magnetic flux is coupled in the appropriate direction.

As an alternative to the embodiments already described in which the flux signal is transmitted in the drill pipe, an embodiment may be provided in which the flux signal is transmitted in part or completely in the surrounding geological formations. As shown diagrammatically in FIG. 3, the drill pipe or the formations can be used as the communication channel, or alternatively a combination of the two. Using the formations as the communication channel permits local noise interference received by the surface receiving unit to be minimised due to the fact that the magnetic sensors can be located away from the influence of the moving high permeability material of the drill string.

Figure 3:
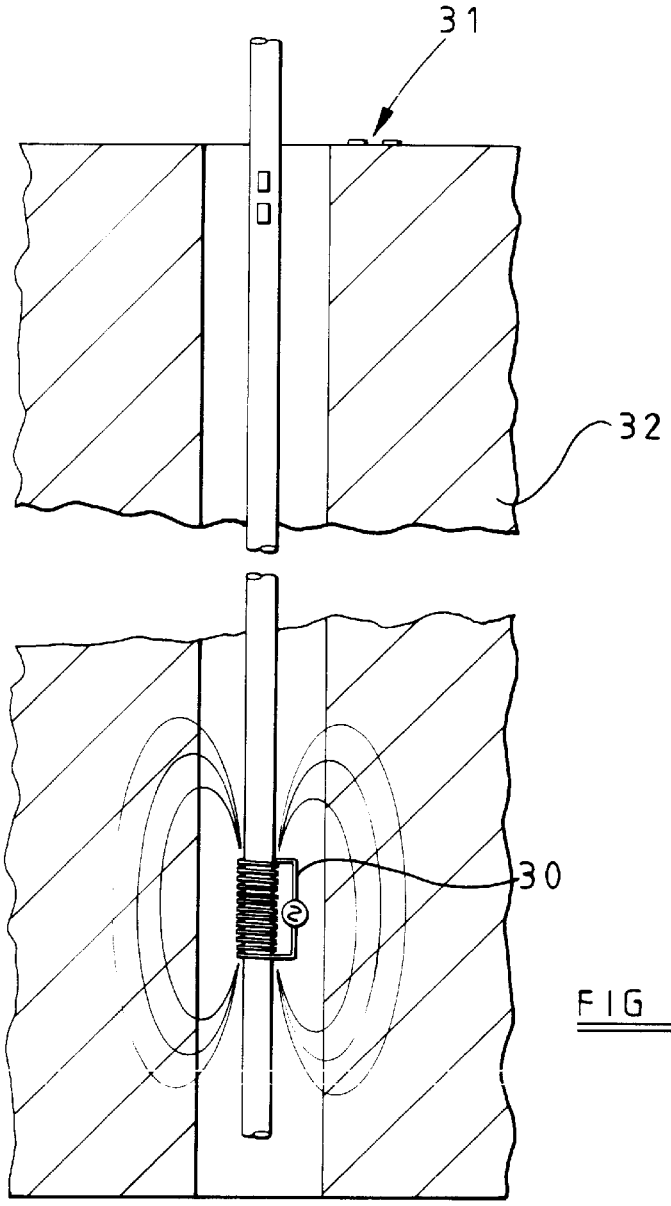

In the embodiment of FIG. 3 the flux signal is transmitted from the downhole transmitting coil 30 within the earth formations 32 to be picked up by an array of receiver magnetometers 31 at the surface.

Figure 4:
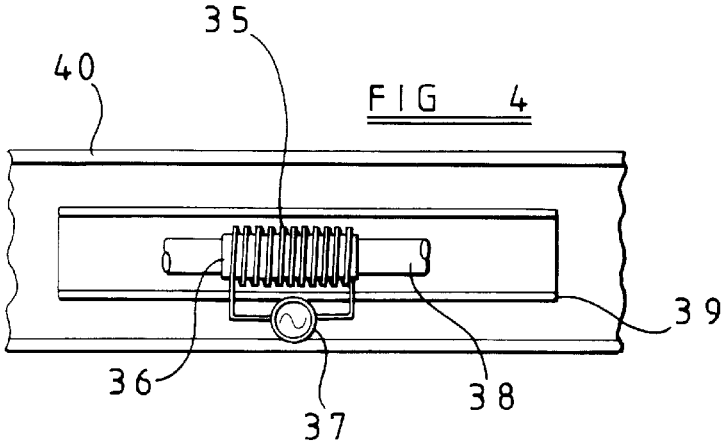
FIGS. 4 and 5 are explanatory diagrams illustrating a possible construction of the downhole transmitter.
Figure 5:
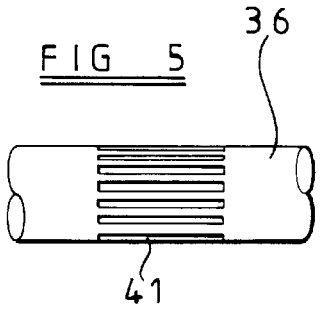

The transmitted flux can be increased by increasing the permeability of the material on which the transmitting coil is wound, and additionally eddy current losses generated by the alternating magnetic fields induced by the coil can be reduced by the use of high resistivity material to break up the conduction paths within the coil. Referring to FIG. 4 a possible arrangement comprises a transmitting coil 35 of N turns wound on a conductive former 36 which in turn surrounds a mandrel 38. Furthermore the transmitting coil 35 is accommodated within a non-conductive housing 39 which is in turn received within the magnetic or non-magnetic drill collar or drill pipe 40. In order to reduce eddy current losses the conductive former 36 is provided with axial slots 41 filled with high resistivity material, such as high permeability ferrite or amorphous alloy material.

Where the flux signal is generated and detected within the drill pipe, the transmitting coil should be wound on high permeability high resistivity ferrite or amorphous alloy material to increase the flux and reduce eddy current losses. However typical conventional sonde configurations utilise Monel or beryllium copper pressure housings, and a magnetic dipole positioned on or within such a configuration will experience considerable losses. The solution to this problem is to mount the transmitting coil within a non-conductive housing made of fibre glass, ceramic or plastic encapsulated material such that the alternating magnetic fields do not induce currents in the material.

Signal detection can be improved by synchronising the receiver and transmitter at the beginning of a data transmission utilising a non-carrier based synchronisation pulse. Such a synchronisation pulse may be generated as a pressure pulse in the mud column when current is applied to the transmitting coil, where the primary power source is a mud-flow operated turbine generator. The synchronisation pressure pulse is detected by a pressure transducer within the mud column which detects a pressure increase due to increased turbine resistance on first applying power to the transmitting coil, and the output from the transducer is processed and used within a phase locked loop to lock the receiver to the transmitter signal, in order to implement a synchronous demodulation system.

I claim:

1. A well data telemetry system for transmitting data around at least a part of a well bore, the system comprising a magnetic flux signal transmitter for propagating a magnetic flux signal around the well bore, means connected to the transmitter for modulating the magnetic flux signal in response to a data signal, and a receive array located to detect and respond to the magnetic flux signal at a position spaced from the transmitter, said receive array comprising at least two magnetometer assemblies, each of said assemblies comprising a sensor having at least one input axis, said receive array being capable of detecting alternating magnetic fields from 0.5 Hz up to at least 10 Khz.

2. A system according to claim 1, wherein said receive array is capable of detecting magnetic flux levels of $10^{-12}$ Tesla or less from 0.5 Hz up to 500 Khz.

3. A system according to claim 1, wherein said sensor is an yttrium iron garnet magnetic sensor.

4. A system according to claim 1, wherein said transmitter is located downhole and said receive array is located at the surface, whereby the system may transmit to the surface data relating to conditions downhole.

5. A system according to claim 1, wherein said transmitter is located at the surface and said receive array is located downhole, whereby the system may transmit control data to a controllable downhole device.

6. A system according to claim 1, wherein both said transmitter and said receive array are located downhole, whereby the system may transmit data from one downhole location to another.

7. A system according to claim 1, wherein said transmitter comprises a transmitting coil wound on a conductive former incorporating inserts of high resistivity material in order to reduce eddy current losses.

8. A system according to claim 1, wherein said transmitter comprises a transmitting coil mounted within a non-conductive housing.

9. A system according to claim 1, further comprising magnetically permeable tubing in the well bore that comprises a drill string consisting of connected lengths of drilling tube.

10. A system according to claim 1, further comprising magnetically permeable tubing in the well bore that comprises continuous tubing of a coiled tubing unit for drilling the well bore or for running downhole sensors in the well bore.

11. A system according to claim 1, further comprising magnetically permeable tubing in the well bore that comprises production tubing in a producing well bore.

12. A well data telemetry system for transmitting data from downhole in a well bore to the surface, the system comprising a magnetic flux signal transmitter located downhole for propagating a magnetic flux signal around at least one of a part of the well bore and through the surrounding geological formations, means connected to said transmitter for modulating the magnetic flux signal in response to a data signal, and a receive array located at the surface to detect and process the magnetic flux signal, said receive array comprising at least two magnetometer assemblies spaced apart to improve a signal-to-noise ratio of the received magnetic flux signal, each of said assemblies comprising a sensor having at least three orthogonal input axes, said magnetometer being capable of detecting alternating magnetic fields.

13. A system according to claim 12, wherein said receive array is capable of detecting magnetic flux levels of $10^{-12}$ Tesla or less from 0.5 Hz up to 500 Khz.

14. A system according to claim 12, wherein said sensor is an yttrium iron garnet magnetic sensor.

15. The system of claim 1, wherein said sensor has at least three input axes.

16. The system of claim 15, wherein said three input axes are orthogonal.

17. The system of claim 16, further comprising a plurality of said receive arrays spaced so that at least one of said arrays is near the well bore and one of said arrays is remote from the well bore to eliminate local and far noise fields, each of said arrays comprising at least two magnetometer assemblies that each comprise at least one said sensor having at least one input axis.

18. The system of claim 1, wherein said magnetic assemblies are spaced from each other to improve a signal-to-noise ratio of the received magnetic flux signal.

19. The system of claim 18, wherein said magnetic assemblies provide a spatial filter for improving the signal-to-noise ratio.

* * * * *